US010544639B2

(12) United States Patent
Sethurathinam et al.

(10) Patent No.: US 10,544,639 B2
(45) Date of Patent: Jan. 28, 2020

(54) DAMAGED SEAL BORE REPAIR DEVICE

(71) Applicant: Halliburton Energy Services, Inc., Houston, TX (US)

(72) Inventors: Ramya Sethurathinam, Singapore (SG); Leo G. Collins, Farmers Branch, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 15/516,621

(22) PCT Filed: Dec. 1, 2014

(86) PCT No.: PCT/US2014/067982
§ 371 (c)(1),
(2) Date: Apr. 3, 2017

(87) PCT Pub. No.: WO2016/089360
PCT Pub. Date: Jun. 9, 2016

(65) Prior Publication Data

US 2017/0247966 A1 Aug. 31, 2017

(51) Int. Cl.

| | |
|---|---|
| ***E21B 27/02*** | (2006.01) |
| ***E21B 17/00*** | (2006.01) |
| ***E21B 23/02*** | (2006.01) |
| ***E21B 33/12*** | (2006.01) |
| ***E21B 33/13*** | (2006.01) |
| ***E21B 37/10*** | (2006.01) |

(52) U.S. Cl.
CPC ..... *E21B 27/02* (2013.01); *E21B 17/00* (2013.01); *E21B 23/02* (2013.01); *E21B 33/12* (2013.01); *E21B 33/13* (2013.01); *E21B 37/10* (2013.01)

(58) Field of Classification Search
CPC ..... E21B 27/02; E21B 17/00; E21B 23/02; E21B 33/12; E21B 33/124; E21B 33/13; E21B 37/10; E21B 29/10
See application file for complete search history.

(56) References Cited

U.S. PATENT DOCUMENTS 3,194,310 A * 7/1965 Loomis ..... E21B 27/02 166/250.08
4,345,766 A * 8/1982 Turanyi ..... E21B 33/08 166/84.1
5,027,895 A 7/1991 Barton
(Continued)

OTHER PUBLICATIONS

Synonyms of "wipe", accessed Jun. 8, 2019 via www.freethesaurus.com.*

(Continued)

*Primary Examiner* — Blake E Michener
(74) *Attorney, Agent, or Firm* — McGuireWoods LLP

(57) ABSTRACT

A device and method of repairing a damaged portion of a seal bore interconnected in a tubing string, where the device can include a chamber, a piston positioned within the chamber, and a filler material contained within the chamber. A force applied to the piston can cause the piston to move within the chamber, which can cause at least a portion of the filler material to be expelled from the chamber, with at least a portion of the expelled filler material filling a recess in the damaged portion of the seal bore, thereby repairing the sealing surface of the seal bore.

24 Claims, 9 Drawing Sheets

(56) References Cited

U.S. PATENT DOCUMENTS

| | | | | |
|---|---|---|---|---|
| 5,577,737 | A * | 11/1996 | Lacy | E21B 33/08 277/308 |
| 7,621,327 | B2 | 11/2009 | Bane | |
| 2001/0027867 | A1 | 10/2001 | Gandy et al. | |
| 2003/0015246 | A1 * | 1/2003 | Hardin | E21B 29/10 138/97 |
| 2004/0112609 | A1 | 6/2004 | Whanger et al. | |
| 2007/0227746 | A1 * | 10/2007 | Xu | E21B 33/1216 166/387 |
| 2009/0107670 | A1 | 4/2009 | Bane | |

OTHER PUBLICATIONS

International Search Report and Written Opinion dated Jul. 30, 2015; International PCT Application No. PCT/US2014/067982.

* cited by examiner

DAMAGED SEAL BORE REPAIR DEVICE

TECHNICAL FIELD

Repair devices can be used to repair damaged and/or leaking tubing strings in a variety of oil and/or gas wellbores. A tubing string can be damaged by installing well tools downhole in the tubing string, conveying the well tools through the tubing string, failure to properly secure threaded connections of the tubing string, or failures in the manufacturing process. A repair device can be run into the tubing string while the tubing string remains in a wellbore, thereby repairing the damaged portion of the tubing string without requiring removal of the tubing string from the wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 2:
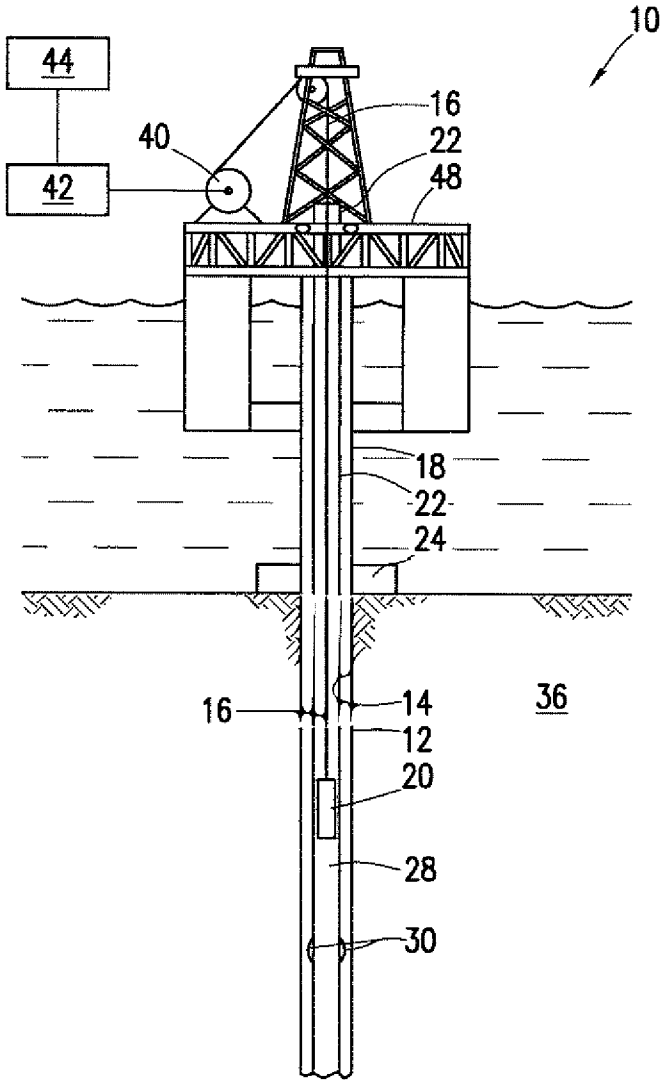
FIG. 2 depicts an off-shore well system showing the repair device.

Oil and gas hydrocarbons are naturally occurring in some subterranean formations. In the oil and gas industry, a subterranean formation containing oil or gas is referred to as a reservoir. A reservoir can be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid. As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; the space between the inside of a casing and the outside of a tubing string in a cased-hole wellbore; and the space between the outside of a well tool and the inside of a casing or tubing string.

Completion of the wellbore can initially require installation of a tubing string into the wellbore. Then various well tools and/or other tubing strings can be run in the wellbore to perform various wellbore operations, such as cementing, perforating, etc. Installation of the well tools and/or other tubing strings can cause damage to the tubing string initially installed in the wellbore.

The tubing string can become damaged during 1) installation of well tools downhole in the tubing string, 2) conveying the well tools through the tubing string, 3) a failure to properly secure threaded connections of the tubing string, or 4) failures in the manufacturing process. The damage can cause an inner wall of the tubing string to lose its sealing capability and/or cause leakage through the wall of the tubing string. The inability to form a seal with a well tool can cause the well tool to fail when it is landed at the location of the damage in the tubing string. Leakage through the tubing wall can also cause loss of a fluid from the tubing string and an inability to maintain pressure in the tubing string.

Tools have been developed to repair this type of damage without having to remove the tubing string from the wellbore. One such tool includes a polishing wheel that is positioned at the location of the damage to the tubing string. A repair material is supplied to an exterior of the polishing wheel while the wheel is rotating within the tubing string. Rotation of the wheel forces the repair material into the recesses caused by the damage and polishes the inner wall of the tubing string, thereby forcing the repair material into the recesses. However, this type of tool requires a motor which can increase the complexity and expense of the tool. The polishing of the inner wall can actually increase a diameter of the inner wall of the tubing string. Additionally, the tool does not prevent excess repair material from being released into a remainder of the tubing string during the polishing operation.

Thus, there is a need for improved repair devices that can repair damaged tubing strings. It has been discovered that a repair device can be used that has a reduced complexity when compared to other repair tools. Additionally, the device can repair the damaged tubing without changing the inner diameter of the tubing string, and prevent release of repair material into the remainder of the tubing string when the recesses are being filled with repair material. Furthermore, the repair device can repair the damage to the tubing string without having to remove the tubing string from the well.

According to certain embodiments, a repair device can include a chamber, a piston positioned within the chamber, and a filler material contained within the chamber. The filler material can be expelled from the chamber and forced to fill a recess in a damaged portion of a tubing string (e.g., a seal bore, a threaded connection, etc.). When the repair device is moved upward, a seal, such as a chevron-type seal with V-shaped seal elements, can wipe away any excess filler material that is not contained within the recess, and cause the damaged portion of the tubing string to be repaired. An actuator can be used to apply a force to the piston, thereby expelling the filler material from the chamber. The force can also be applied to the piston by a means other than an actuator. For example, hydraulic pressure from an internal flow passage of the tubing string or coiled tubing can act on the piston to move it within the chamber, thereby expelling some of the filler material from the chamber.

Figure 9:
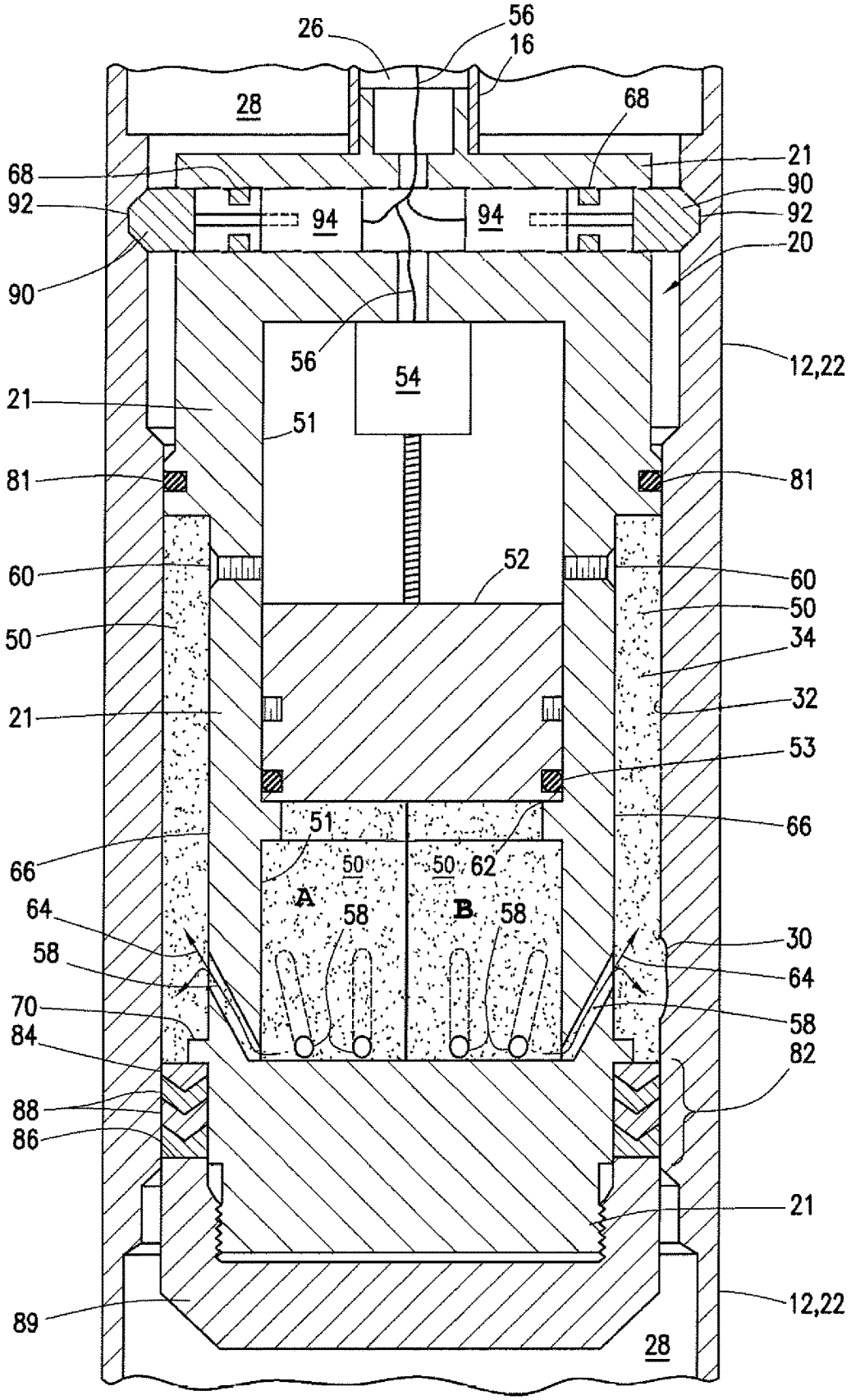
FIG. 9 depicts a partial cross-sectional view of the seal bore and repair device of FIG. 4 comprising more than one chamber and more than one filler material.

According to certain other embodiments, a repair device can include multiple chambers 50 (referring to FIG. 9), one or more pistons, and multiple filler materials contained within the chambers. The filler materials can be expelled from the chambers by moving the piston(s) and forcing the filler material out of the chambers to fill a recess in a damaged portion of a tubing string. The multiple filler materials can mix sufficiently within the repair device and/or in an annulus between the repair device and the tubing string to create a filler material that will remain within the recesses. For example, if a two-part epoxy were used as a filler material, one chamber can contain an epoxy part A (referring to FIG. 9) material and another chamber can contain an epoxy part B (referring to FIG. 9) material. When the piston is moved by application of a force, portions of the epoxy part A material and epoxy part B materials can be expelled from the chambers and sufficiently mixed in the repair device and/or the annulus. After mixing, the final viscosity of the mixture can increase, compared to the initial viscosity of each separate component, thereby filling the recess and repairing the damaged portion of the tubing string.

Figure 1:
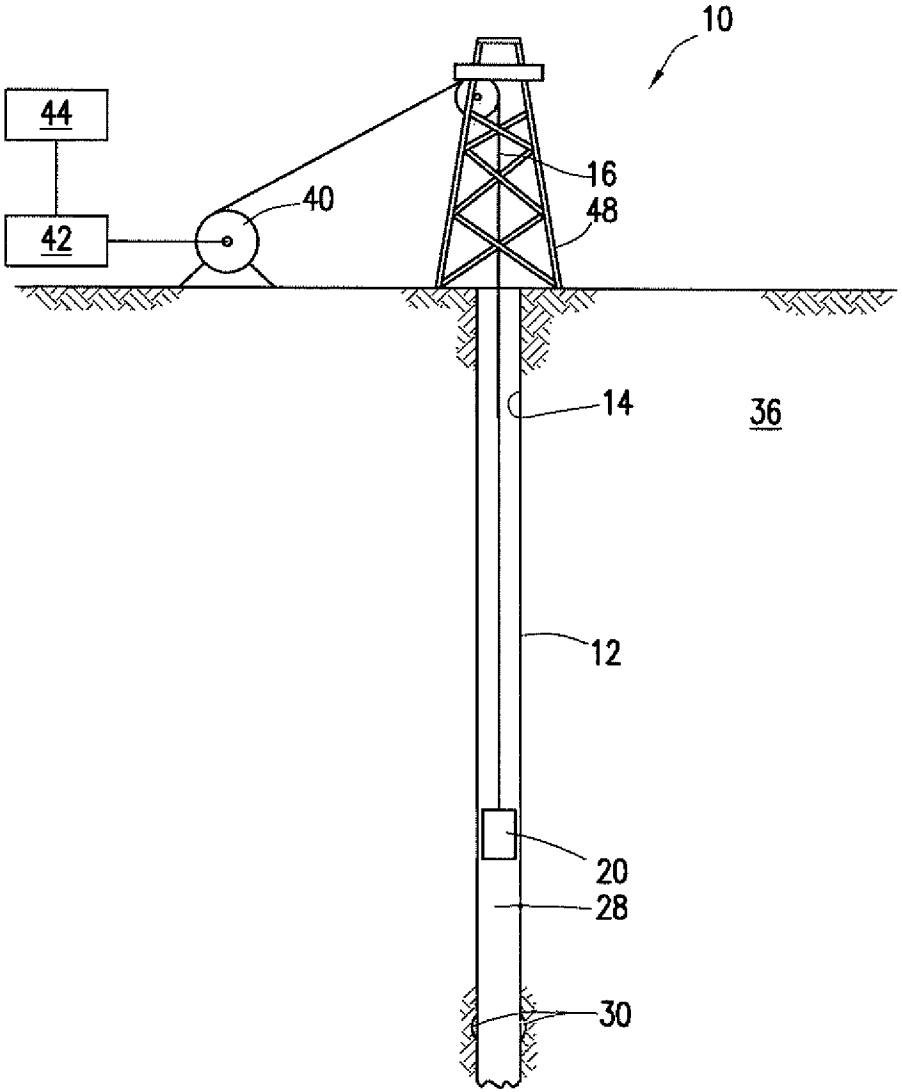
FIG. 1 depicts an on-land well system showing a repair device.

Turning to the Figures, FIG. 1 depicts an on-land well system 10. The well system 10 can include at least one wellbore 14 that penetrates a subterranean formation 36. The subterranean formation 36 can be a portion of a reservoir or adjacent to a reservoir. The wellbore 14 can include a casing 12. FIG. 1 depicts only a generally vertical wellbore, but it should be understood that the wellbore 14 can alternatively include only a generally horizontal wellbore section. Alternatively, or in addition to, a portion of the wellbore can be generally vertical and another portion of the wellbore can be generally horizontal. Therefore, it can be understood that any configuration of a wellbore 14 can be used in the well system 10.

FIG. 1 shows a portion of the casing 12 that is damaged. The damage has caused recesses 30 to be formed in the casing 12 after the casing 12 was installed in the wellbore 14. FIG. 2 depicts an off-shore well system 10, including a subsea wellbore 14 with a riser string 18 connected between a wellhead 24 and a rig 48. A wellbore 14 includes a casing 12 extending downward from the wellhead 24. A tubing string 22 can be installed from the rig 48, through the riser string 18, and into the casing 12. Similar recesses 30 have been formed in the tubing string 22 due to damage to the tubing string 22. A casing 12 is but one example of a tubing string. Therefore, it is to be understood that any discussion referring to a tubing string 22, applies equally to a casing 12.

As seen in FIGS. 1 and 2, a repair device 20 is lowered into a wellbore 14 on a conveyance 16 (e.g., a wireline, a coiled tubing, segmented tubing, etc.) to a location where the tubing string 22 is damaged. The conveyance 16 can be controlled by a controller 42, which can receive control information from an operator interface 44 to control the positioning of the repair device 20 downhole. Alternatively, or in addition, the controller 42 can automatically control the conveyance 16 of the repair device 20 downhole to the desired location. FIGS. 1 and 2 show a spool 40 that can be required for wireline and coiled tubing conveyances 16. However, the spool 40 may not be required if a segmented tubing string is used to position the repair device 20 downhole.

Figure 3A:
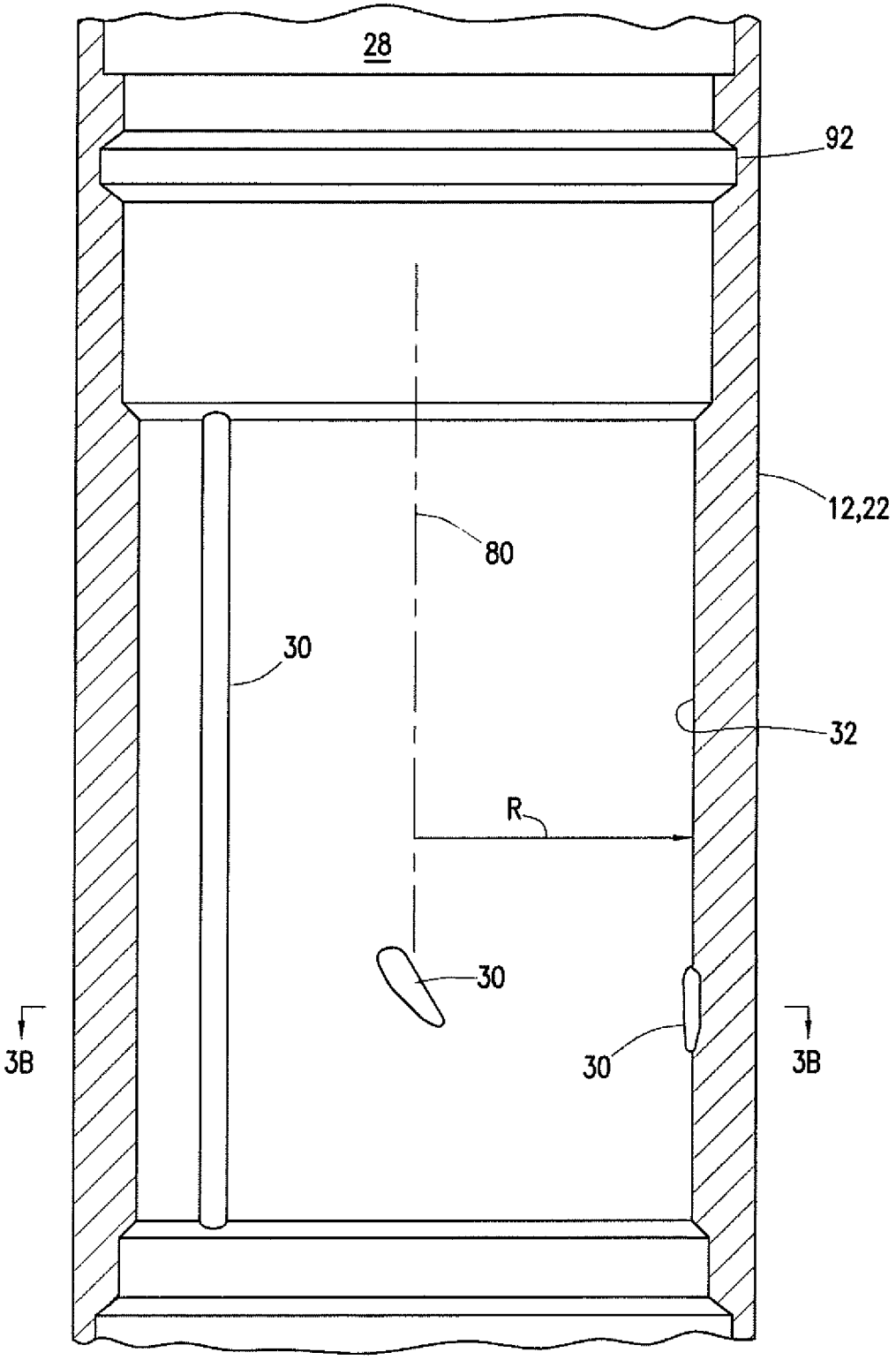
FIG. 3A depicts a partial cross-sectional view of a damaged seal bore.

FIG. 3A illustrates a seal bore 32 in the tubing string 22 that can have an inner radius R that is smaller than an inner radius of the remainder of the tubing string 22. This smaller radius R can increase the likelihood that damage could occur to the seal bore 32 when well tools, other tubing strings, etc., travel past the seal bore 32 in the tubing string 22. As used herein, a "seal bore" 32 is a polished bore designed to accept a seal assembly, such as may be used in a permanent production packer. The damage to the seal bore 32 is illustrated by the recesses 30. One recess 30 can be a groove formed longitudinally along the seal bore 32. The groove recess 30 can be formed by a wireline or coiled tubing that rubs the seal bore 32 as it travels through the seal bore 32, and/or by a well tool as it travels through the seal bore 32. The other two recesses 30 are depicted as gouges and/or dents that can be formed by an object striking the seal bore 32. The gouges and/or dents can result from material being removed from the seal bore 32, and/or material of the seal bore 32 being deformed.

Figure 3B:
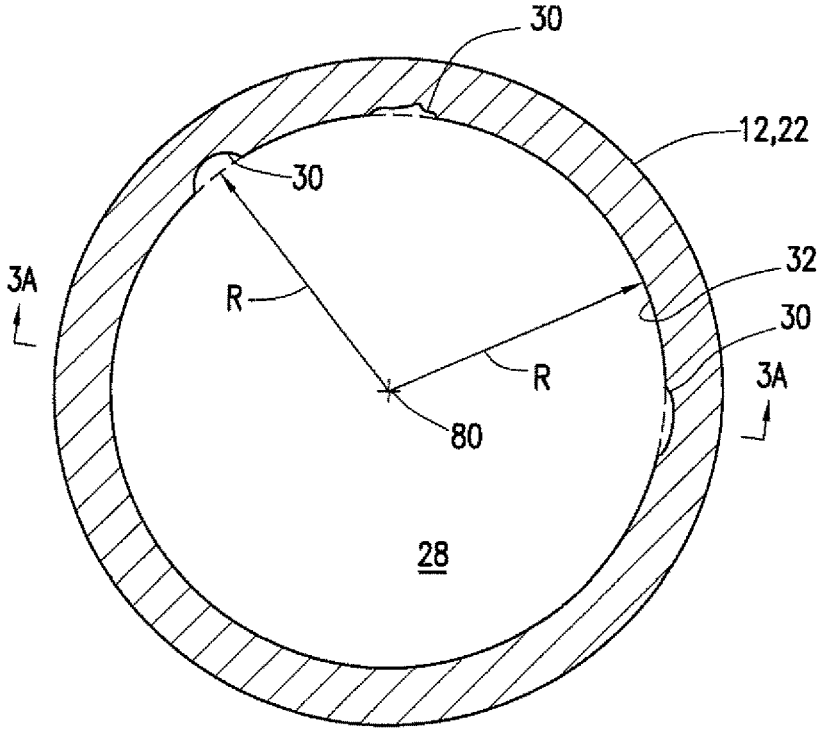
FIG. 3B depicts the cross-sectional view of the seal bore from FIG. 3A taken along line 3B.

FIG. 3B depicts a cross-sectional view of the tubing string 22 at the location of the recesses 30. As used herein, a "recess" 30 is a portion of the seal bore 32 that is radially enlarged due to damage. In other words, the seal bore 32 material in the recess is at a greater distance from the central axis 80 than the remainder of the undamaged seal bore. The dashed lines illustrate the original position of the material of the seal bore 32 at the recesses 30 before the damage occurred. The repair device 20 can be used to fill these recesses 30 with a filler material 50 (not shown) up to approximately the dashed lines, such that the seal bore 32 again provides a circumferentially contiguous sealing surface in the seal bore 32 at the location of each recess 30.

Referring again to FIG. 3A, this figure depicts a damaged seal bore 32 prior to the repair device 20 being run into the seal bore 32. When a repair operation is desired the repair device 20 is conveyed through the flow passage 28 to the damaged seal bore 32. The profile 92 is located near the damaged seal bore 32. The repair device 20 is landed in the profile 92, and a portion of the repair device 20 is extended into the damaged seal bore 32.

Figure 4:
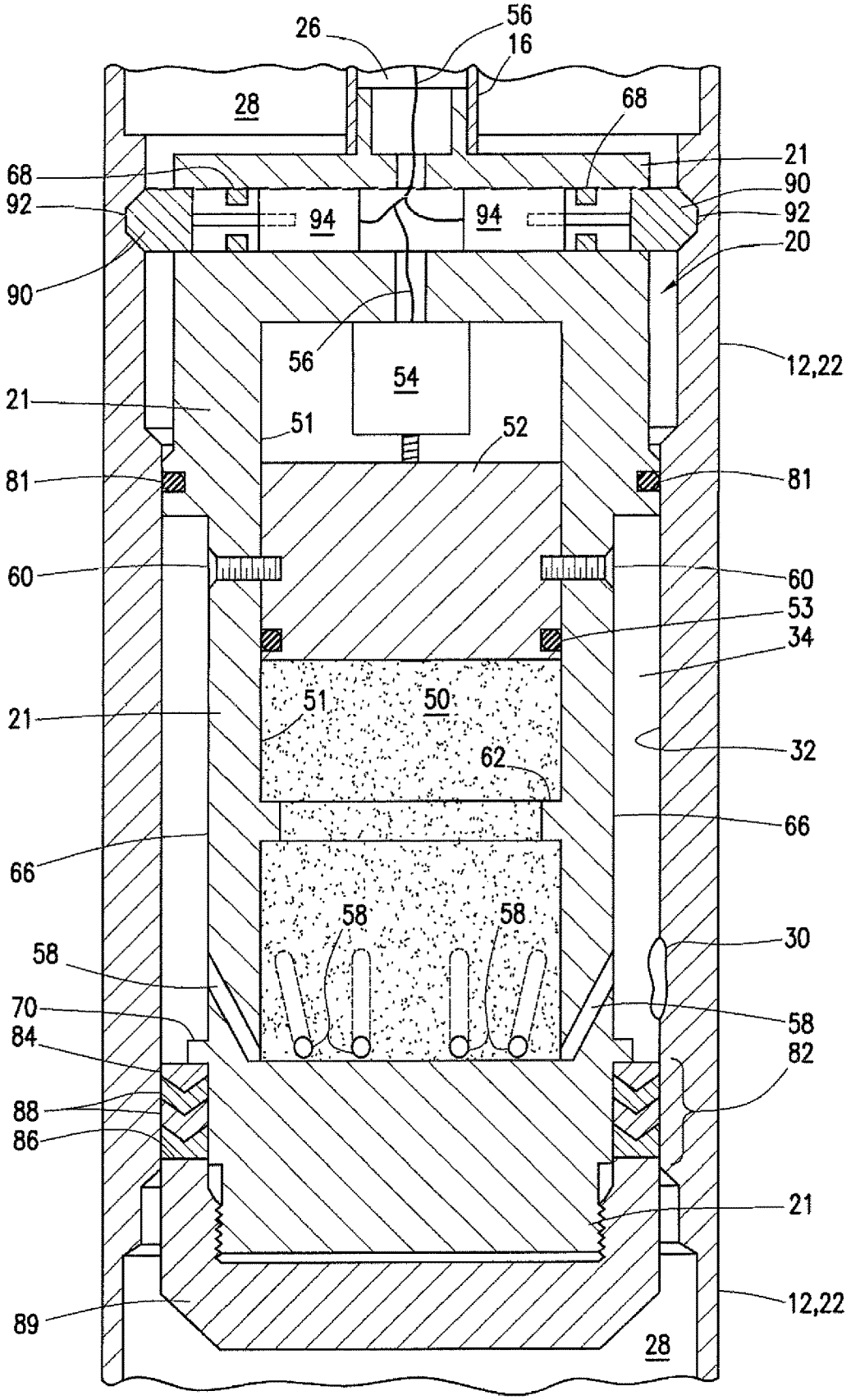
FIG. 4 depicts a partial cross-sectional view of the seal bore with the repair device according to certain embodiments located inside the seal bore, prior to repairing the seal bore, where the repair device includes a piston actuator.

FIG. 4 depicts the damaged seal bore 32 after the repair device 20 has been landed in the profile 92. The repair device 20 can be run in through the flow passage 28 on a conveyance 16. The conveyance 16 can be connected to the top of the repair device 20 by various means. The conveyance 16 can include control lines 56 (e.g., electrical, hydraulic, pneumatic, optical, etc.) for controlling actuators and/or pistons of the repair device 20.

Figure 7:
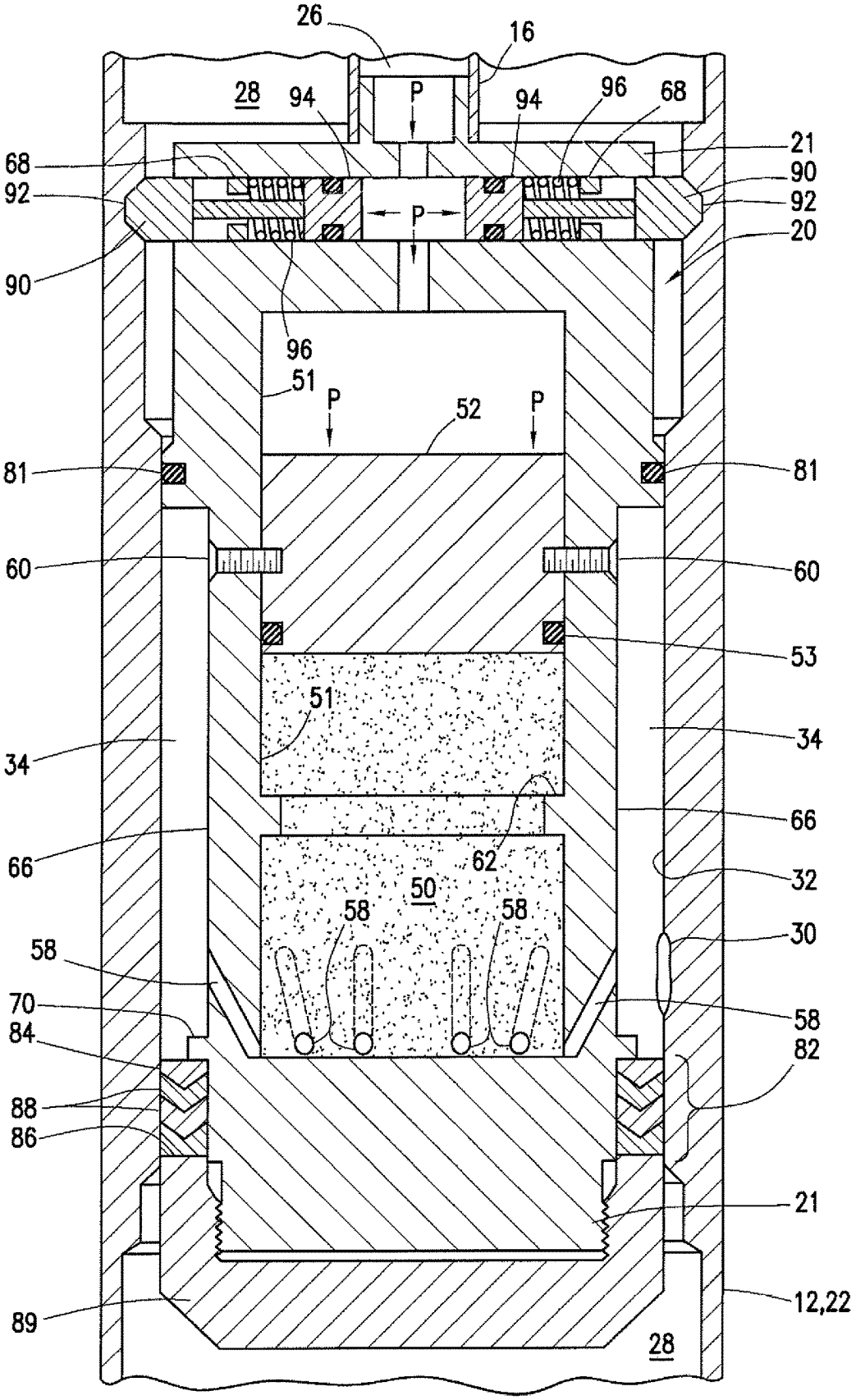
FIG. 7 depicts a partial cross-sectional view of the seal bore with the repair device according to certain other embodiments located inside the seal bore, prior to repairing the seal bore.

The repair device 20 can include a body 21, engagement members 90, a chamber 51, a piston 52, and first and second annular seals 81, 82. The engagement members 90 can be extended and retracted in a variety of ways. FIGS. 4 and 7 show two certain embodiments of actuators 94 that can be used to control extension/retraction of the engagement members 90. FIG. 4 illustrates actuators 94 as being electrically, hydraulically, optically, and/or pneumatically controlled via the control lines 56. In this configuration, the actuators 94 are fixed to the body 21 and an extendable rod of the actuator 94 is attached to its respective engagement member 90. Therefore, extension/retraction of the engagement members 90 is controlled by their respective actuators 94. In an embodiment, actuators 94 may include seal 68. FIG. 7 illustrates the actuators 94 as being pistons that are radially biased inward by respective biasing devices 96. Pressure P applied in the flow passage 26 can be used to extend the respective engagement member 90 radially outward or removal of the pressure P can retract the respective engagement member 90.

Referring again to FIG. 4, when the engagement members 90 land in the profile 92 near the damaged seal bore 32, then the repair device 20 is positioned at the predetermined location. The repair device 20 longitudinally extends into the damaged portion of the tubing string 22, which is a seal bore 32 in this example. The first and second annular seals 81, 82 straddle a large portion of the seal bore 32. However, it should be understood that it is not necessary for the seals 81, 82 to straddle the complete seal bore 32, merely that portion of the seal bore 32 that is in need of repair. Moreover, the seals 81, 82 can straddle a larger portion of the seal bore 32 than just the damaged portion.

The first and second annular seals 81, 82 seal off an annulus 34 formed between the outside of the repair device 20 and the inner wall of the seal bore 32. An annular recess 66 can be provided in the body 21 to provide more volume in the annulus 34, but it is not necessary to have a recess 66 in the body 21. The annular space provided by the first and second annular seals 81, 82 can be sufficient to support the repair operation.

The first and second annular seals 81, 82 can form a seal against the seal bore 32 to prevent the expelled filler material 50 from escaping the annulus 34 (except through bleeder flow passages and possibly a longitudinal recess 30). The first annular seal 81 is shown as an O-ring type seal in FIGS. 4, 5, 7 and 8. However, the first annular seal 81 can be any type seal that provides a sufficient seal to prevent the filler material 50 from escaping the annulus 34. For example, the first annular seal 81 can be a metal seal with a resilient seal element that energizes the metal seal into a sealing engagement with the seal bore 32. Additionally, the first annular seal 81 can be an active seal that radially extends into sealing engagement with the seal bore 32 once the repair device 20 has been located at the predetermined location in the tubing string 22.

The second annular seal 82 is shown in FIGS. 4, 5, 7 and 8 as being a multi-element seal. Two metal end rings 84, 86 straddle one or more semi-resilient (or semi-rigid) seal elements 88. These seal elements 88 are shown as being similar to chevron seal elements. However, other seal elements can be used. A first end ring 84 can be referred to as the "male" end ring, while the second end ring 86 can be referred to as the "female" end ring. The male end ring 84 can be assembled to the bottom of the repair device 20, thereby abutting the shoulder 70 of the body 21. Then the one or more semi-resilient seal elements 88 can be assembled to the bottom of the repair device 20, thereby abutting the metal male end ring 84. The female end ring 86 can then be assembled to the bottom of the repair device 20, thereby abutting the semi-resilient seal elements 88, followed by the installation of the end cap 89 onto the bottom of the repair device 20. The end cap 89 can be threaded onto the bottom of the repair device 20 to provide the appropriate compression of the semi-resilient seal elements 88 in the second annular seal 82. However, it is not necessary that the annular seal 82 be installed on the repair device 20 as given above. For example, the second annular seal 82 could be installed on the repair device 20 as a complete assembly and then the end cap 89 installed to retain the seal 82 on the repair device 20.

The male and female end rings 84, 86 are preferably non-resilient, with the semi-resilient seal elements 88 providing a controlled interference fit in the seal bore 32. The seal elements 88 can be made out of a semi-resilient seal material, such as 3× moly-filled TEFLON® material, that provides a proper amount of interference fit with the seal bore 32 to form a seal without substantially extruding into the recess 30 when it wipes the excess material 50 from the seal bore 32. However, other seal assemblies and seal materials can be used as long as they do not substantially extrude into the recess 30 when the second annular seal 82 wipes the excess filler material 50 from the seal bore 32.

The chamber 51 of the repair device 20 can provide a storage area for a filler material 50. The chamber can be a bladder (or multiple bladders) located within the body. When the repair device 20 is positioned at the predetermined location in the tubing string 22, then the filler material 50 can be expelled from the chamber into the annulus 34, where at least a portion of the expelled filler material 50 fills each recess 30.

Figure 8:
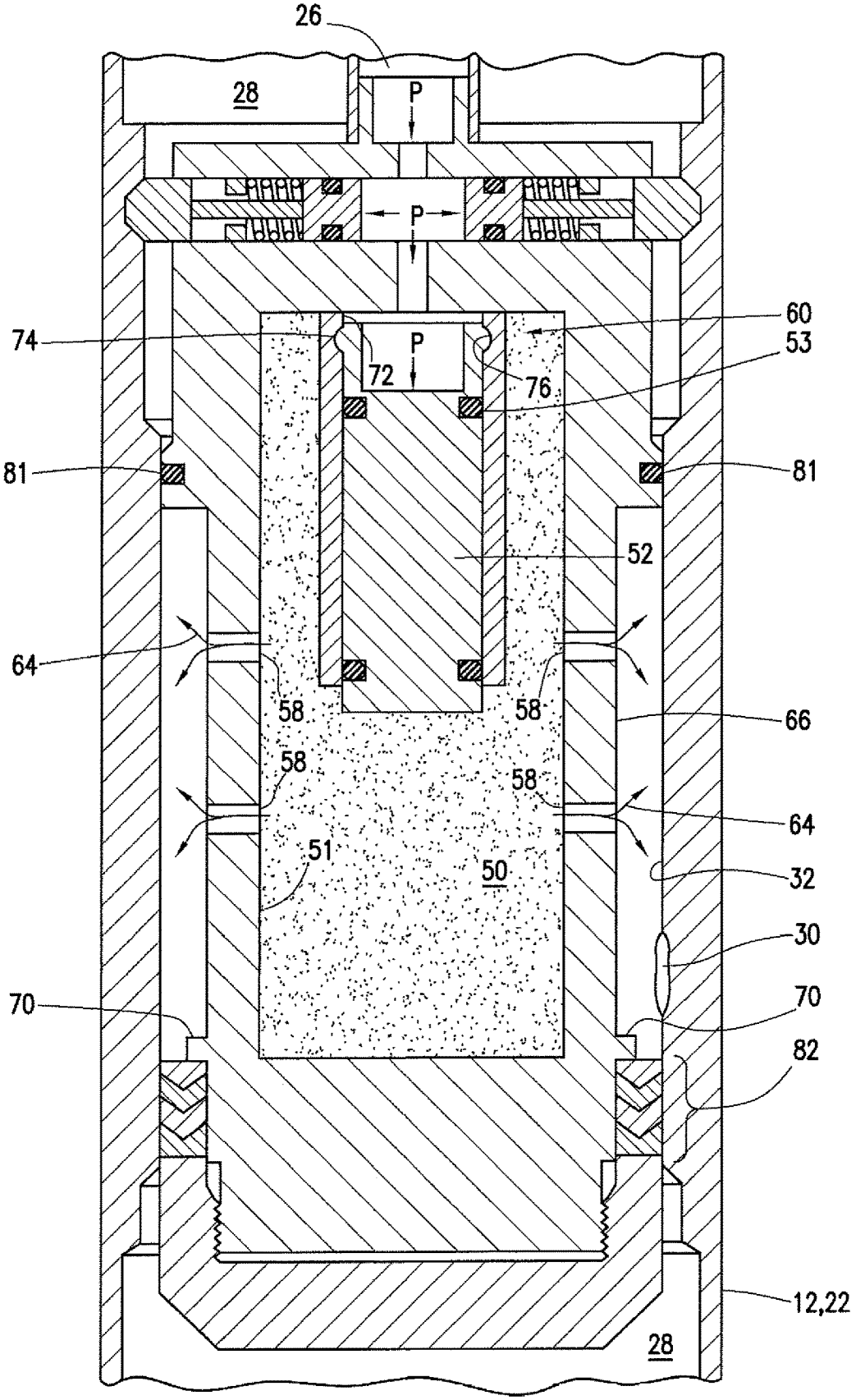
FIG. 8 depicts a partial cross-sectional view of the seal bore with a repair device according to certain other embodiments located inside the seal bore, prior to repairing the seal bore.

The chamber 51 can include a piston 52, which is configured to move up and down within the chamber 51. The piston can include a seal 53 that prevents fluid flow past the piston 52. The piston 52 can include a latch mechanism 60, which can be a one-time set/unset mechanism, such as shear pins shown in FIGS. 4, 5, and 7, or resettable, such as a resilient button configuration seen in FIG. 8. In an embodiment, latch mechanism may comprise detents 74 and 76 as seen in FIG. 8. However, many other configurations of the latch mechanism 60 can also be used. The latch mechanism 60 can prevent movement of the piston 52 until a predetermined amount of force is applied to the piston 52. When the applied force is equal to or greater than the predetermined amount, then the latch mechanism 60 can release the piston so it can travel within the chamber. This can ensure that premature activation of the repair device 20 does not occur.

Figure 5:
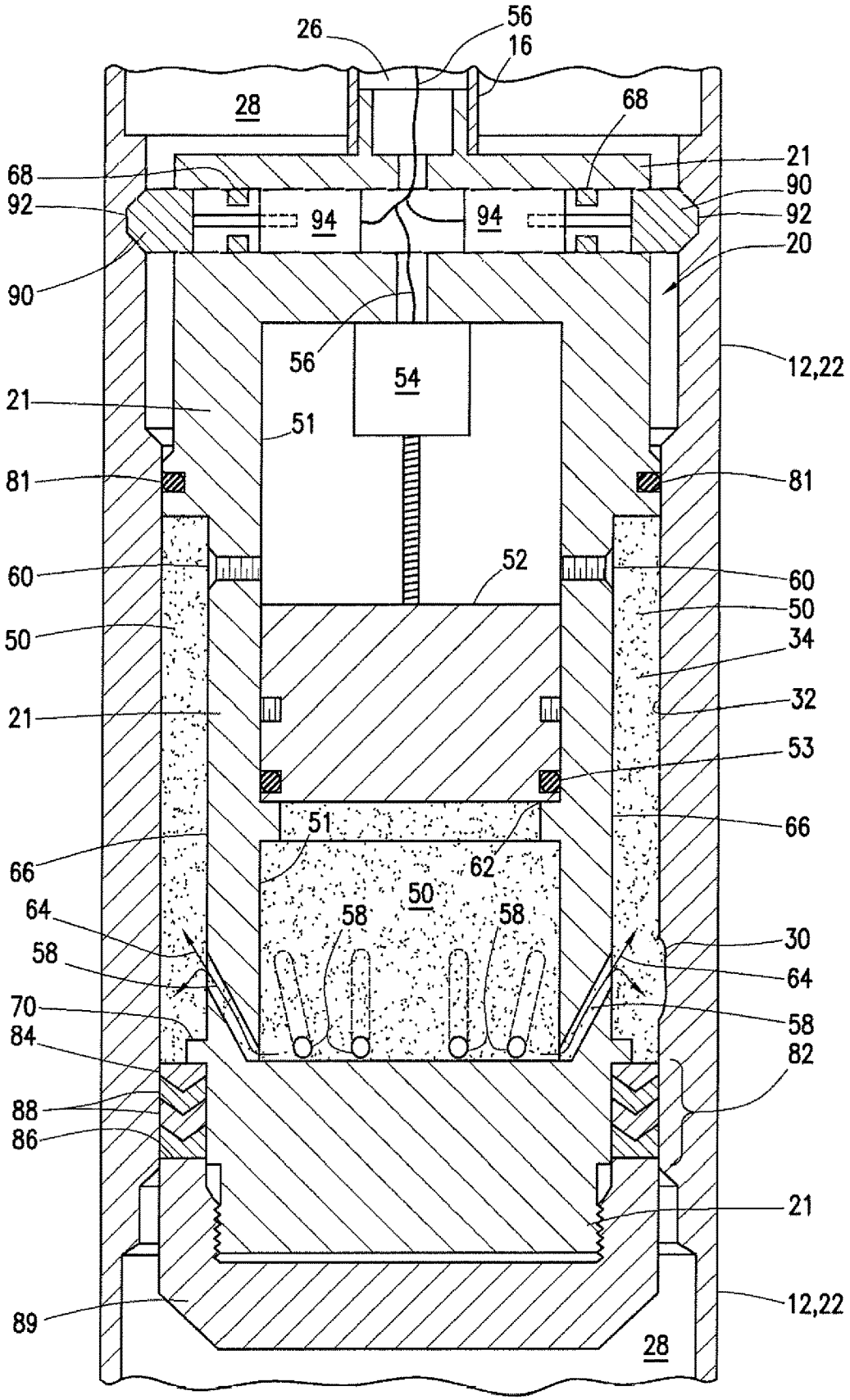
FIG. 5 depicts a partial cross-sectional view of the seal bore and repair device of FIG. 4, with a filler material expelled from a chamber.

Referring to FIG. 5, when the actuator 54 is actuated, it can supply sufficient force to the piston 52 to release the latch mechanism 60 and begin movement of the piston within the chamber. The piston 52 movement creates a pressure differential across the filler material 50 contained in the chamber 51 and causes at least a portion of the filler material 50 to be expelled from the chamber 51 through ports 58 and into the annulus 34. Flow of the expelled filler material 50 is indicated by arrows 64. Please note, that any number of ports 58 can be used to provide flow paths for the filler material 50 from the chamber into the annulus 34. The expelled filler material 50 can generally fill the annulus 34, thereby displacing any fluid that may have been trapped within the annulus 34 when the repair device 20 was installed in the seal bore 32.

Bleeder flow passages (not shown) can provide an exit path for the trapped fluid being displaced from the annulus 34. These bleeder flow passages can include a one-way check valve to permit the trapped fluid to exit the annulus 34 while preventing any well fluids from entering the annulus 34. However, the bleeder flow passages can also be open flow passages without including a valve.

The bleeder flow passages can provide an indication to an operator that the filler material 50 has filled the annulus 34. The filler material 50 will generally be a higher viscosity fluid than the fluid that is trapped in the annulus 34. Therefore, when the trapped fluid exits the annulus through the bleeder flow passages and the higher viscosity filler material 50 begins to flow through the bleeder flow passages, the pressure differential across the filler material 50 can increase. This pressure increase can be detected by the operator at the rig 48 or remote location. Upon the detection, the operator can deactivate the actuator 54, and/or remove pressure applied to the piston 52, to prevent expelling any more filler material 50 from the chamber 51. This increased pressure can indicate that the annulus 34 and any recesses in the annulus are filled with the filler material 50.

However, the pressure indication is not required for the repair operation. The amount of filler material 50 to be expelled into the annulus 34 can be determined beforehand. The expelled volume of filler material 50 can be controlled by adjusting the amount of travel of the piston 52, the size of the piston 52, the amount of time the actuator 54 is actuated, etc. The radially reduced annular ring 62 can be used as a stop for the piston 52. Therefore, when the latch mechanism 60 releases the piston 52, the actuator can move the piston 52 until it engages the stop 62. Since the volume of the filler material 50 displaced by the piston 52 is known, then no remote detection is required to complete the process of filling the annulus 34.

Examples of suitable filler materials 50 include, but are not limited to, a plastic resin, a silicone based fluid with additives, a coating compound, an epoxy, and combinations thereof. The material 50 can be any substance so long as the substance can flow from the chamber 51 and can be retained in the recess 30 once the repair device 20 is retrieved from the tubing string 22. The substance would preferably produce a surface with sufficient rigidity that a seal can be formed in the tubing string at the location of the recess 30, e.g., when a well tool is landed in the seal bore 32.

The expelled filler material 50 should be of sufficient viscosity to remain in each recess 30 when the repair device 20 is removed from the tubing string 22. The viscosity of the expelled filler material 50 can be the same as the initial viscosity of the filler material 50 prior to it being expelled into the annulus 34. However, the expelled filler material 50 can have an increase in viscosity after being expelled. By way of example, the expelled filler material can become at least partially cured in the annulus in order to remain within the recess. As used herein, the term "cure" and all grammatical variations thereof means the process of developing compressive strength and becoming hard or solid through heat or a chemical reaction.

Once each recess 30 is filled with the expelled filler material 50, and the desired viscosity for the expelled filler material 50 is reached, then the repair device 20 can be pulled out of the seal bore 32 and out of the tubing string 22. The desired viscosity is the viscosity required to prevent the expelled filler material 50 from flowing out of the recess 30 when the repair device is pulled out of the seal bore 32. The expelled filler material 50 can continue to harden even after the repair device 20 has been removed from the seal bore 32.

The repair device 20 can be removed from the tubing string 22 after the recess 30 have been filled with the filler material 50. The second annular seal 82 can be used to wipe (or squeegee) any excess expelled filler material 50 from the seal bore "without substantially removing" any of the expelled filler material 50 that was forced into the recess 30. A small amount of the expelled filler material 50 may be removed from the recess 30 producing a dimple in the expelled filler material 50 in the recess. However, it is preferable, in order for a seal to be created, that the dimple does not increase the radius R of the seal bore 32 at the recess 30 by more than 0.001 inches. Therefore, the phrase "without substantially removing" refers to not removing more than a dimple with a depth of 0.001 inches of material 50 from the filled recess 30. Additionally, the resulting surface of the expelled filler material 50 that fills the recess 30 can be at least within radius R+/−0.001 inches from the center axis 80. This resulting surface can provide a circumferentially contiguous sealing surface at the location of the recess 30 in the seal bore 32. This contiguous sealing surface can provide sufficient sealing for seals that are landed in the seal bore 32 and sealingly engage the seal bore 32.

Figure 6B:
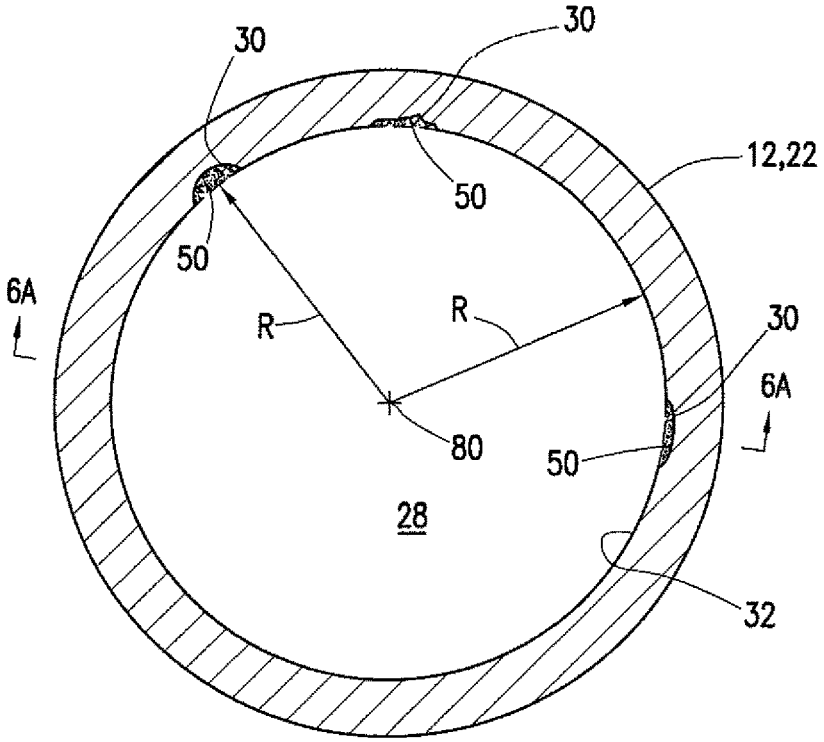
FIG. 6B depicts the cross-sectional view of the seal bore from FIG. 6A taken along line 6B.
Figure 6A:
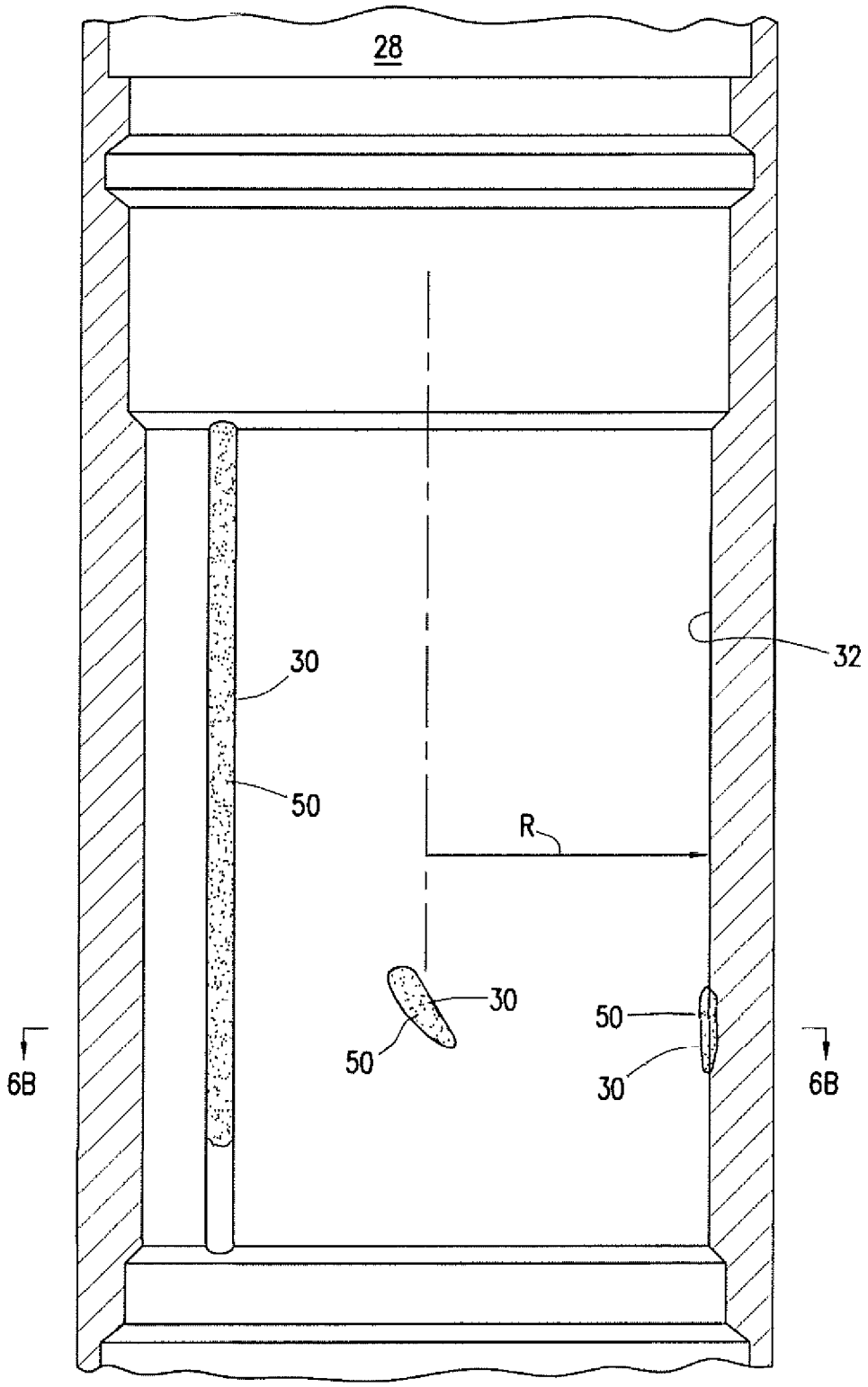
FIG. 6A depicts a partial cross-sectional view of a seal bore after the repair device is removed from the seal bore and the damaged seal bore is repaired.

Referring to FIG. 6A, the seal bore 32 is shown with the repair device 20 removed. It can be seen that excess expelled filler material 50 has been removed from the seal bore 32, with a portion of the expelled filler material 50 being left in the recesses 30 to repair the seal bore 32. Please note that the filler material 50 does not completely fill the longitudinal recess 30. This is due to the position of the repair device 20 as seen in FIGS. 4 and 5. The second annular seal 82 is shown positioned above the bottom of the seal bore 32. This demonstrates that it is not necessary to completely fill all recesses 30 in the damaged seal bore 32 to provide sufficient sealing for seals that are landed in the seal bore 32 after the damaged seal bore 32 has been repaired. However, the recesses 30 and/or portions of a recess 30 that are positioned at a location in the seal bore 32 that are required for forming a seal with a sealing assembly should be filled with the material 50.

FIG. 6B depicts the seal bore 32 with the repair device 20 removed. It can be seen that the recesses 30 are filled with the material 50 such that the seal bore 32 provides a circumferentially contiguous sealing surface at radius R from the center axis 80. The dashed lines represent the surface of the seal bore 32 at the locations of the recesses 30 before the seal bore 32 was damaged. Therefore, the repair operation replaces the removed or deformed seal bore 32 material with portions of the filler material 50 to again provide a circumferential sealing surface in the seal bore 32 at the recesses 30. This repair operation can also be performed by other certain embodiments of the repair device 20.

FIG. 7 depicts another certain embodiment of the repair device 20. In this embodiment, the actuator 54 for the piston 52 has been removed. The piston 52 is moved in the chamber by pressure P which can be applied through flow passage 26 in the conveyance 16. Once the repair device 20 is positioned at or near the predetermined location in the tubing string 22, then the pressure P can be increased. The initial pressure increase can cause the pistons 94 to radially extend the engagement member 90 into engagement with the profile 92, thereby locking the repair device 20 at the predetermined location. Continued increase of the pressure P can produce a force on the piston 52 that equals or exceeds the predetermined amount. At this pressure, the latch mechanism releases the piston 52 and the piston 52 moves in the chamber 51 until it abuts the stop 62. This piston movement expels a portion of the filler material 50 from the chamber 51 into the annulus 34. The rest of the operation of this certain embodiment is similar to the operation of the repair device 20 described above and depicted in FIGS. 4-6.

FIG. 8 depicts yet another certain embodiment of the repair device 20. This embodiment is very similar to the embodiment given in FIG. 7, except for the piston 52, ports 58, and the latch mechanism 60. The piston 52 can be contained within another chamber 72 that is contained within the chamber 51. When the pressure P is increased to the predetermined amount, the latch mechanism 60 will release the piston 52. As the piston 52 travels downward in the chamber 51, the piston 52 will displace a volume of the filler material 50, thereby creating a pressure differential across the filler material 50 and expelling at least a portion of the filler material 50 into the annulus 34 through radially directed ports 58. The ports 58 are longitudinally and circumferentially spaced apart to provide a varied distribution of the expelled filler material 50 in the annulus 34. This embodiment can be useful when the filler material cures via a chemical reaction.

By way of example, there can be a 2 part epoxy system comprising two or more ingredients, such as a curable resin and a curing agent, where the curable resin is included in one chamber and the curing agent is included in another chamber. The curable resin and the curing agent can then be expelled into the annulus via the distributed ports to enable adequate mixing of the resin and agent within the annulus to form the filler material. According to certain embodiments, the number of chambers and the number and distribution of the ports are selected such that an adequate amount of mixing occurs to enable the mixed filler material to fill the recesses. The rest of the operation of this embodiment is similar to the operation of the repair device 20 described above and depicted in FIGS. 4-6.

Therefore, the present system is well adapted to attain the ends and advantages mentioned as well as those that are inherent therein. The particular embodiments disclosed above are illustrative only, as the present invention can be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above can be altered or modified and all such variations are considered within the scope and spirit of the present invention.

As used herein, the relative terms "up" and "above" and all grammatical variations thereof mean at a location closer to the wellhead of the wellbore. As used herein, the relative terms "down" and "below" and all grammatical variations thereof mean at a location farther away from the wellhead of the wellbore. It is also to be understood that as used herein, the term "metal" is meant to include pure metals and also metal alloys without the need to continually specify that the metal can also be a metal alloy. It should also be understood that, as used herein, "first," "second," "third," etc., are arbitrarily assigned and are merely intended to differentiate between two or more seals, chambers, pistons, etc., as the case can be, and does not indicate any particular orientation or sequence. Furthermore, it is to be understood that the mere use of the term "first" does not require that there be any "second," and the mere use of the term "second" does not require that there be any "third," etc.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that can be incorporated herein by reference, the definitions that are consistent with this specification should be adopted.

What is claimed is:

1. A repair device that repairs a damaged portion of a seal bore interconnected in a tubing string, the device comprising:

(A) a chamber;

(B) a piston positioned within the chamber;

(C) a filler material contained within the chamber; and (D) a first annular seal on the repair device;

(E) a second annular seal on the repair device, wherein the second annular seal is a chevron seal;

wherein a force applied to the piston causes the piston to move within the chamber, and the piston movement causes at least a portion of the filler material to be expelled from the chamber, and wherein at least a portion of the expelled filler material fills a recess in the damaged portion wherein the second annular seal is configured to wipe excess filler material from the seal bore as the repair device is removed from the seal bore without substantially removing the portion of the expelled filler material in the recess.

2. The device according to claim 1, wherein the force is supplied by an actuator.

3. The device according to claim 2, wherein the actuator is selected from the group consisting of a hydraulic actuator, an electrical actuator, a magnetic actuator, a mechanical actuator, a pneumatic actuator, a swellable material actuator, and an explosive component actuator.

4. The device according to claim 1, wherein the recess is a void in an inside surface of the seal bore, and wherein the recess extends radially outward from the surface.

5. The device according to claim 4, wherein the recess is caused by at least one of removal of seal bore material from the seal bore and deformation of the seal bore material, and wherein the recess creates a non-contiguous sealing surface in the seal bore, and wherein the portion of the expelled filler material fills the recess and provides a circumferentially contiguous sealing surface in the seal bore at the location of the recess.

6. The device according to claim 1, wherein the portion of the expelled filler material is retained within the recess at least partially due to the viscosity of the expelled filler material.

7. The device according to claim 6, wherein the viscosity of the expelled filler material is greater than the initial viscosity of the filler material contained within the chamber.

8. The device according to claim 1, wherein the chamber includes multiple chambers and the filler material includes multiple ingredients, wherein each chamber contains a respective ingredient, wherein the movement of the piston expels the ingredients from their respective chambers and the ingredients mix in the annular space to produce the filler material.

9. The device according to claim 8, wherein at least one of the ingredients is an activating agent, and wherein the activating agent causes the filler material to increase in viscosity after mixing of the ingredients.

10. The device according to claim 1, further comprising a lock mandrel with extendable engagement members, and the first and second annular seals longitudinally spaced apart on the repair device.

11. The device according to claim 10, wherein the engagement members are extended into engagement with a profile in the tubing string, and wherein the first and second annular seals are located within the seal bore in response to the engagement of the profile with the engagement members.

12. The device according to claim 10, wherein the first and second annular seals straddle the damaged portion of the seal bore, thereby forming a sealed annulus between an exterior wall of the repair device and an interior wall of the seal bore when the first and second annular seals are located within the seal bore.

13. The device according to claim 1, further comprising a latch mechanism, wherein movement of the piston is prevented by the latch mechanism when the applied force is less than a predetermined amount, and movement of the piston is permitted by the latch mechanism when the applied force is equal to or greater than the predetermined amount.

14. The device according to claim 1, wherein the second annular seal is configured to remove no more than 0.001 inches of the expelled filler material in the recess.

15. A method of repairing a damaged portion of a seal bore interconnected in a tubing string, the method comprising:

installing a repair device into a tubing string to a predetermined location, wherein the repair device comprises:

(A) a chamber;

(B) a piston positioned within the chamber;

(C) a filler material contained within the chamber;

(D) first annular seal on the repair device;

(E) a second annular seal on the repair device, wherein the second annular seal is a chevron seal;

applying a force to the piston, causing movement of the piston and expelling at least a portion of the filler material into the annular space in response to the movement;

filling a recess in the damaged portion of the seal bore with at least a portion of the expelled filler material; and removing the repair device from the seal bore such that the second annular seal wipes excess filler material from the seal bore as the repair device is removed from the seal bore without substantially removing the portion of the expelled filler material in the recess.

16. The method according to claim 15, wherein the installing, the applying, the filling, the lifting, the wiping, and the forming are performed in a single-trip of the repair device in the tubing string.

17. The method according to claim 15, wherein the recess is caused by at least one of removal of seal bore material from the seal bore and deformation of the seal bore material, and wherein the recess creates a non-contiguous sealing surface in the seal bore.

18. The method according to claim 17, further comprising replacing the removed and/or deformed seal bore material by filling the recess with the portion of the expelled filler material, thereby providing a circumferentially contiguous sealing surface in the seal bore at the location of the recess.

19. The method according to claim 15, the installing further comprises extending engagement members of the repair device into engagement with a profile in the tubing string, wherein the repair device is locked at the predetermined location, and positioning the first and second annular seals of the repair device within the seal bore.

20. The method according to claim 19, wherein the first and second annular seals straddle the damaged portion of the seal bore to form a sealed annulus between an exterior wall of the repair device and an interior wall of the seal bore when the first and second annular seals are located within the seal bore.

21. The method according to claim 19, further comprising retracting the engagement members of the repair device out of engagement with the profile to unlock the repair device and allow the repair device to be removed from the tubing string.

22. The method according to claim 15, wherein the repair device further comprises a latch mechanism, wherein movement of the piston is prevented by the latch mechanism when the applied force is less than a predetermined amount, and movement of the piston is permitted by the latch mechanism when the applied force is equal to or greater than the predetermined amount.

23. The method according to claim 15, wherein the force is supplied by an actuator.

24. The method according to claim 23, wherein the actuator is selected from the group consisting of a hydraulic actuator, an electrical actuator, a magnetic actuator, a mechanical actuator, a pneumatic actuator, a swellable material actuator, and an explosive component actuator.

* * * * *